US009878224B2

(12) United States Patent
Suzuki et al.

(10) Patent No.: US 9,878,224 B2
(45) Date of Patent: Jan. 30, 2018

(54) ROD-LIKE OBJECT FOR BALL GAMES AND METHOD FOR USING THE SAME

(71) Applicant: Takahito Suzuki, Osaka-shi, Osaka (JP)

(72) Inventors: Takahito Suzuki, Osaka (JP); Tutomu Kawasaki, Osaka (JP); Kouji Takigami, Osaka (JP)

(73) Assignee: Takahito Suzuki, Osaka-shi, Osaka (JP)

( * ) Notice: Subject to any disclaimer, the term of this patent is extended or adjusted under 35 U.S.C. 154(b) by 0 days.

(21) Appl. No.: 14/763,644

(22) PCT Filed: Oct. 15, 2013

(86) PCT No.: PCT/JP2013/077899
§ 371 (c)(1),
(2) Date: Jul. 27, 2015

(87) PCT Pub. No.: WO2014/125676
PCT Pub. Date: Aug. 21, 2014

(65) Prior Publication Data

US 2015/0360100 A1 Dec. 17, 2015

(30) Foreign Application Priority Data

Feb. 14, 2013 (JP) ..... 2013-026388
Apr. 30, 2013 (JP) ..... 2013-095861

(51) Int. Cl.
*A63B 53/10* (2015.01)
*A63B 15/00* (2006.01)
(Continued)

(52) U.S. Cl.
CPC ..... *A63B 53/10* (2013.01); *A63B 15/00* (2013.01); *A63B 15/005* (2013.01);
(Continued)

(58) Field of Classification Search
CPC ..... A63B 53/08; A63B 53/12
(Continued)

(56) References Cited

U.S. PATENT DOCUMENTS 2,153,550 A * 4/1939 Cowdery ..... A63B 53/12 473/323
4,537,403 A * 8/1985 Farina ..... A63B 53/007 473/203
(Continued)

FOREIGN PATENT DOCUMENTS

JP 50-032060 U 4/1975
JP 50032060 U * 4/1975
(Continued)

OTHER PUBLICATIONS

English translation of the International Search Report of PCT/JP2013/077899.

*Primary Examiner* — Aarti B Berdichevsky
*Assistant Examiner* — Rayshun Peng
(74) *Attorney, Agent, or Firm* — Muncy, Geissler, Olds & Lowe, P.C.

(57) ABSTRACT

A rod-like object for ball games 1 usable for a ball games or practice thereof, the rod-like object 1 comprising a grip 20 on a proximal end side of an elongated main body 10, the main body 10 comprising a first flexible part 12 in which primary deflective deformation occurs along a first imaginary plane, a second flexible part 14 that is provided more toward the proximal end side than the first flexible part 12 is and in which principal deflective deformation occurs along a second imaginary plane, and a highly rigid part 19 interposed between the first flexible part 12 and the second flexible part 14, the first imaginary plane and the second imaginary plane intersecting each other, and the highly rigid part 19 having a flexural rigidity in a direction of the first imaginary plane that is equal to or greater than a flexural
(Continued)

rigidity of the second flexible part 14 in the same direction and a flexural rigidity in a direction of the second imaginary plane that is equal to or greater than a flexural rigidity of the first flexible part 12 in the same direction.

13 Claims, 6 Drawing Sheets

(51) Int. Cl.
*A63B 102/32* (2015.01)
*A63B 60/00* (2015.01)
*A63B 102/18* (2015.01)

(52) U.S. Cl.
CPC ... *A63B 2060/0081* (2015.10); *A63B 2102/18* (2015.10); *A63B 2102/32* (2015.10)

(58) Field of Classification Search
USPC ..... 473/291, 316–323
See application file for complete search history.

(56) References Cited

U.S. PATENT DOCUMENTS 5,588,921 A * 12/1996 Parsick ..... A63B 53/14 473/295
5,685,781 A * 11/1997 Pedersen ..... A63B 53/10 473/318

FOREIGN PATENT DOCUMENTS

JP 56-144573 U 10/1981
JP 2005-152613 A 6/2005

* cited by examiner

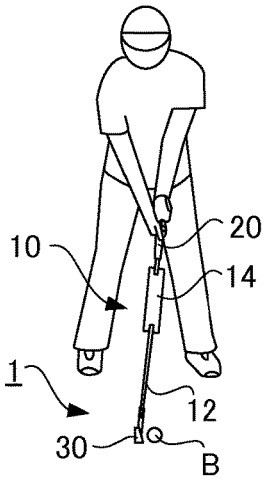
Fig. 3(a)
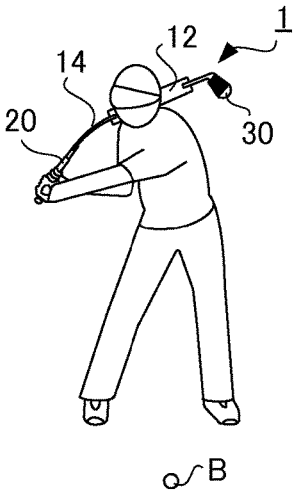
Fig. 3(b)
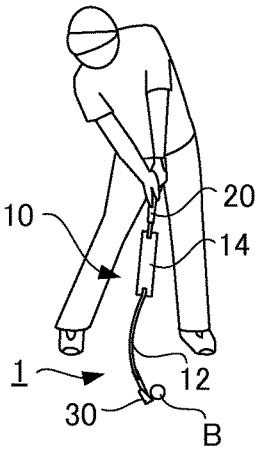
Fig. 3(c)
Fig. 4(a)
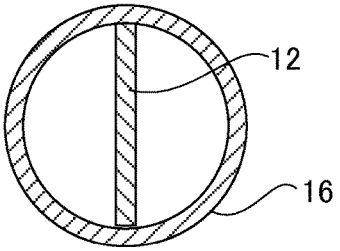
Fig. 4(b)
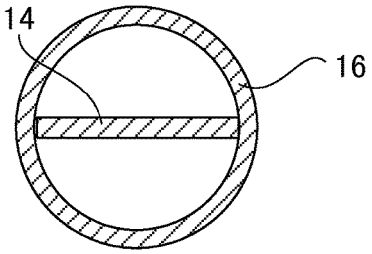

Fig. 7(a)
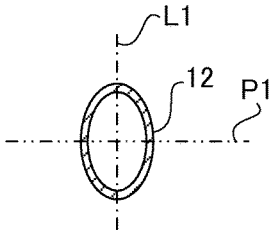
Fig. 7(b)
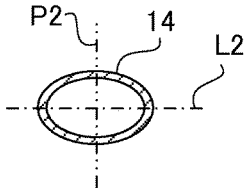
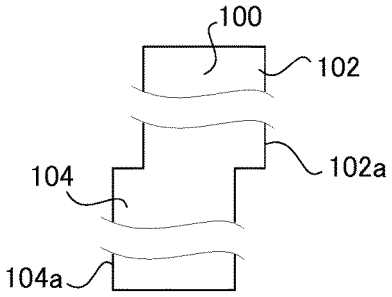
Fig. 8(a)
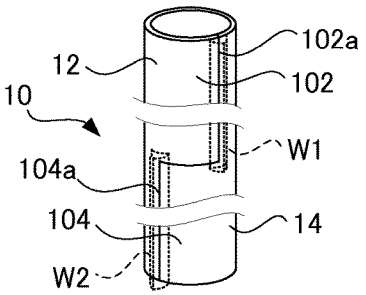
Fig. 8(b)
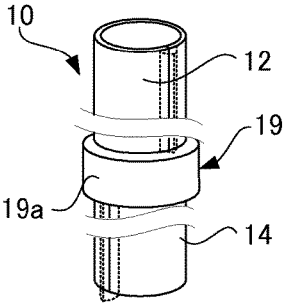
Fig. 8(c)

ROD-LIKE OBJECT FOR BALL GAMES AND METHOD FOR USING THE SAME

TECHNICAL FIELD

The present invention relates to a rod-like object for ball games, and more specifically, relates to a rod-like object usable for golf, baseball, and similar ball games or the practice thereof. Also, the present invention relates to a method for using a rod-like object for ball games in which such a rod-like object is used.

BACKGROUND ART

In ball games such as golf and baseball in which a ball is hit with a rod-like object such as a club or a bat, one of the tasks is to hit the ball hard and far. It is effective to make use of the flex of a rod-like object for accomplishing such a task, and therefore, to date, research has been carried out on the configuration of a rod-like object for improving flex. For example, Patent Literature 1 discloses a golf club shaft with improved shaft flex, in which flexural rigidity is varied in the longitudinal direction of the shaft to provide a plurality of zones having a lower flexural rigidity.

CITATION LIST

Patent Literature

[PTL 1] JP 2005-152613A

SUMMARY OF INVENTION

Technical Problem

However, with respect to the shaft disclosed in Patent Literature 1 above, the flex of the shaft itself occurs in a random direction, it is thus difficult to feel the differences in flex resulting from swing variations, and therefore it is difficult to make efficient use of the flex of the shaft.

Accordingly, an objective of the present invention is to provide a rod-like object for ball games with which an efficient swing can be easily performed through effective use of the flex of the rod-like object. Moreover, another objective of the present invention is to provide a method for using a rod-like object for ball games by which an object to be hit is efficiently hit using such a rod-like object for ball games.

Solution to Problem

One of the above-described object of the present invention is achieved by a rod-like object for ball games usable for ball games or practice thereof, the rod-like object comprising a grip on a proximal end side of an elongated main body, the main body comprising a first flexible part in which primary deflective deformation occurs along a first imaginary plane, a second flexible part that is provided more toward the proximal end side than the first flexible part is and in which principal deflective deformation occurs along a second imaginary plane, and a highly rigid part interposed between the first flexible part and the second flexible part, the first imaginary plane and the second imaginary plane intersecting each other, and the highly rigid part having a flexural rigidity in a direction of the first imaginary plane that is equal to or greater than a flexural rigidity of the second flexible part in the same direction and a flexural rigidity in a direction of the second imaginary plane that is equal to or greater than a flexural rigidity of the first flexible part in the same direction.

It is preferable that in this rod-like object for ball games, the first flexible part and the second flexible part both have a length longer than a length of the highly rigid part.

It is preferable that the first flexible part and the second flexible part are both formed in a flat shape and are flexible in a thickness direction.

It is preferable that the first flexible part and the second flexible part are both composed of a flat, plate-like object and are flexible in a thickness direction.

It is preferable that the first flexible part, the highly rigid part, and the second flexible part all have a center line positioned on a straight line along an axial line of the main body. In this configuration, it is preferable that the first imaginary plane and the second imaginary plane are both positioned so as to include the axial line of the main body and are perpendicular to each other, and it is preferable that the highly rigid part has such a shape that the first flexible part and the second flexible part intersect on the axial line of the main body.

The main body can comprise a ball hitting part at its tip.

The other above-described objective of the present invention is achieved by a method for using a rod-like object for ball games usable for ball games or practice thereof, the rod-like object comprising a grip on a proximal end side of an elongated main body, the main body comprising a first flexible part in which primary deflective deformation occurs along a first imaginary plane and a second flexible part that is provided more toward the proximal end side than the first flexible part is and in which principal deflective deformation occurs along a second imaginary plane, the first imaginary plane and the second imaginary plane intersecting each other, the method comprising a first step in which a user holds the grip and swings up the rod-like object, a second step in which the user swings down the rod-like object along one of the first imaginary plane and the second imaginary plane to deflectively deform the one of the first flexible part and the second flexible part downward, and a third step in which the user swings the rod-like object toward a ball along the other of the first flexible part and the second flexible part to hit the ball while deflecting the other of the first flexible part and the second flexible part forward.

In this method for using a rod-like object for ball games, it is preferable that the second step is initiated after the one of the first flexible part and the second flexible part is deflectively deformed in a direction of upward swing due to the first step.

Moreover, it is preferable that the third step comprises a step in which, before the other of the first flexible part and the second flexible part is deflected forward, the other of the first flexible part and the second flexible part is deflected backward by taking advantage of inertial force obtained when the one of the first flexible part and the second flexible part is deflectively deformed downward due to the second step.

Advantageous Effects of Invention

According to the present invention, it is possible to provide a rod-like object for ball games with which an efficient swing can be easily performed through effective use of the flex of the rod-like object. Moreover, according to the present invention, it is possible to provide a method for using a rod-like object for ball games by which an object to be hit is efficiently hit using such a rod-like object for ball games.

BRIEF DESCRIPTION OF DRAWINGS

FIGS. 3(*a*)-3(*c*) include drawings for explaining a method for using the rod-like object for ball games shown in FIG. 1, and FIG. 3(*a*) shows a state at address, FIG. 3(*b*) shows a state during the course of a downswing, and FIG. 3(*c*) shows a state at impact.

FIGS. 4(*a*)-4(*b*) include cross-sectional views showing relevant parts of a rod-like object for ball games according to another embodiment of the present invention, and FIG. 4(*a*) is a cross-sectional view of a first flexible part and FIG. 4(*b*) is a cross-sectional view of a second flexible part.

FIGS. 7(*a*)-7(*b*) include cross-sectional views showing relevant parts of a rod-like object for ball games according to yet another embodiment of the present invention, and FIG. 7(*a*) is a cross-sectional view of a first flexible part and FIG. 7(*b*) is a cross-sectional view of a second flexible part.

FIGS. 8(*a*)-8(*c*) include drawings showing relevant parts of a rod-like object for ball games according to yet another embodiment of the present invention, and FIG. 8(*a*) is a development view of a main part, FIG. 8(*b*) is a perspective view of the main part, and FIG. 8(*c*) is a perspective view of the main part to which a highly rigid part is attached.

DESCRIPTION OF EMBODIMENTS

Figure 1:
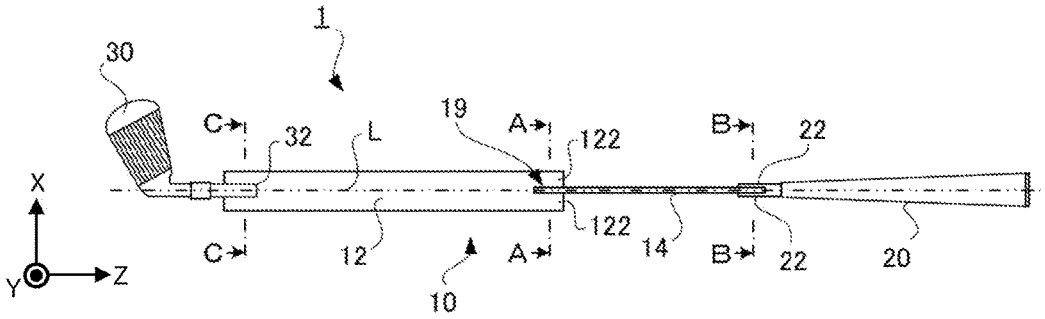
FIG. 1 is a front view of a rod-like object for ball games according to one embodiment of the present invention.

Below, an embodiment of the present invention will now be described with reference to the attached drawings. FIG. 1 is a front view of a rod-like object for ball games according to one embodiment of the present invention. A rod-like object 1 for ball games shown in FIG. 1 is used as a golf club or for practicing a golf swing, and includes an elongated main body 10, a grip 20 provided on the proximal end side of the main body 10, and a hitting part (head) 30 provided on the distal end side of the main body 10.

The main body 10 includes a first flexible part 12 and a second flexible part 14 that are formed in a flat, strip-like shape and a highly rigid part 19 interposed between the first flexible part 12 and the second flexible part 14. The first flexible part 12, the highly rigid part 19, and the second flexible part 14 all have a center line positioned on a straight line along an axial line L of the main body 10, and the second flexible part 14 is positioned on the proximal end side relative to the first flexible part 12. The first flexible part 12 and the second flexible part 14 are plate-like objects made of a metallic material such as titanium, aluminum, magnesium, or alloy thereof, or a non-metallic material such as carbon or graphite, and are deflectively deformable in their thickness directions. It is possible that the first flexible part 12 and the second flexible part 14, for example, are of the same material and have the same cross-sectional shape.

The first flexible part 12 includes a pair of holding parts 122 and 122 on the proximal end side. The distal end part of the second flexible part 14 is held between the holding parts 122 and 122 and is integrated into a single body by, for example, welding, brazing, or adhesive-bonding. The highly rigid part 19 is composed of the overlapping part of the first flexible part 12 and the second flexible part 14. A means of connecting the first flexible part 12 and the second flexible part 14 is not particularly limited as long as they are reliably coupled to each other, such as adhesive-bonding, fitting, or fixing using a screw or a rivet, and furthermore they may be configured to be attachable to and detachable from each other. It is also possible to provide a pair of holding parts on the second flexible part 14 to hold the proximal end part of the first flexible part 12 therebetween.

Lengths L1 and L2 of the first flexible part 12 and the second flexible part 14, respectively, in the direction of the axial line L may be different from each other or may be the same, and it is preferable that the lengths are both longer than a length L3 of the highly rigid part 19 in the direction of the axial line L such that the flex of the first flexible part 12 and the flex of the second flexible part 14 can be effectively used.

Figure 2A:
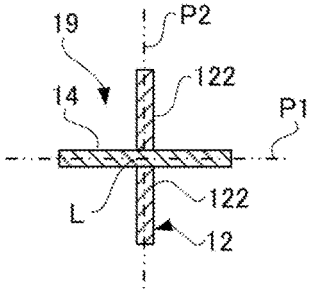
FIGS. 2(*a*)-2(*c*) include cross-sectional views of the rod-like object for ball games shown in FIG. 1, and FIG. 2(*a*) is a cross-sectional view taken along the line A-A, FIG. 2(*b*) is cross-sectional view taken along the line B-B, and FIG. 2(*c*) is cross-sectional view taken along the line C-C.
Figure 2B:
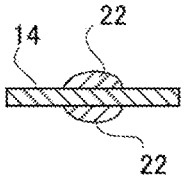
Figure 2C:
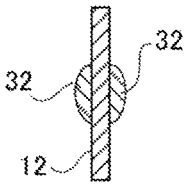

FIG. 2(*a*) is a cross-sectional view taken along the line A-A in FIG. 1. The first flexible part 12 and the second flexible part 14 are positioned so as to include the axial line L and are perpendicular to each other in a cross-section that is at right angles to the axial line L. Since the first flexible part 12 and the second flexible part 14 intersect on the axial line L, the highly rigid part 19 is formed in a cross shape.

The first flexible part 12 is configured to deflectively deform along a first imaginary plane P1, and the second flexible part 14 is configured to deflectively deform along a second imaginary plane P2. The first imaginary plane P1 and the second imaginary plane P2 are perpendicular to each other on the axial line L. The first imaginary plane P1 and the second imaginary plane P2 indicate the directions of primary deflection of the first flexible part 12 and the second flexible part 14, respectively. The direction of primary deflective deformation means the direction in which the amount of deflection in the direction of action of external force when one end of the first flexible part 12, or one end of the second flexible part 14, is fixed and external force is applied to the other end is maximum, and is normally the direction in which flexural rigidity is minimum. The present invention does not exclude a configuration in which the first flexible part 12 and the second flexible part 14 deflectively deform slightly in directions other than their primary deflective directions. The direction in which the deforming amount of the first flexible part 12 becomes maximum is indicated with Y which is defined as a first imaginary direction. The direction in which the deforming amount of the second flexible part 14 becomes maximum is indicated with X which is defined a second imaginary direction. The first imaginary plane P1 extends in Y direction and Z direction. The second imaginary plane P2 extends in X direction and Z direction.

The highly rigid part 19 has a flexural rigidity in the direction of the first imaginary plane P1 and a flexural rigidity in the direction of the second imaginary plane P2 that are both equal to or greater than the flexural rigidities of the first flexible part 12 and the second flexible part 14 compared in the respective directions. That is, in the direction of the first imaginary plane P1, the flexural rigidity of the second flexible part 14 is at a greater value than the flexural rigidity of the first flexible part 12, while the flexural rigidity of the highly rigid part 19 in the direction of the first imaginary plane P1 is equal to or greater than the flexural rigidity of the second flexible part 14 in this direction. Similarly, in the direction of the second imaginary plane P2, the flexural rigidity of the first flexible part 12 is at a greater value than the flexural rigidity of the second flexible part 14, while the flexural rigidity of the highly rigid part 19 in the direction of the second imaginary plane P2 is equal to or greater than the flexural rigidity of the first flexible part 12 in this direction. Configuring the highly rigid part 19 in this way makes it possible, when the first flexible part 12 and the second flexible part 14 flexurally deform in different directions, to nullify the influence of bending on each other by the highly rigid part 19, and thus reliably enables the first flexible part 12 and the second flexible part 14 to flex along the first imaginary plane P1 and the second imaginary plane P2, respectively. The flexural rigidity can be obtained from the product of a Young's modulus and a second moment of area, and can be calculated from the material and the cross-sectional shape. When it is difficult to calculate flexural rigidity from the cross-sectional shape, the flexural rigidity may be obtained by a three-point bending test as in the measurement of flexural rigidity of a golf shaft that is commonly performed.

It is preferable that the flexural rigidities of the first flexible part 12 and the second flexible part 14 are to such an extent that, when a user holds the grip 20 in one hand and the hitting part 30 in the other, and causes deflective deformation to be produced along the first imaginary plane P1 and the second imaginary plane P2, one of the first flexible part 12 and the second flexible part 14 curves in an arc shape from the boundary with the highly rigid part 19 while the deflective deformation of the other is not visually observable. In the case of such a configuration, whether or not the flexural rigidity of the highly rigid part 19 is equal to or greater than the flexural rigidity of the first flexible part 12 or the second flexible part 14 in the width direction can be easily checked visually.

As shown in FIG. 1, the grip 20 includes a pair of holding parts 22 and 22, and the second flexible part 14 is held between the holding parts 22 and 22 as shown in FIG. 2(*b*) and welded for integration into a single body. The hitting part 30 includes a pair of holding parts 32 and 32, and the first flexible part 12 is held between the holding parts 32 and 32 as shown in FIG. 2(*c*) and welded for integration into a single body. As with the fixation between the first flexible part 12 and the second flexible part 14, other known means of coupling as described above can be suitably used for fixing the grip 20 and the hitting part 30 to the main part 10. The orientation of the first flexible part 12 relative to the hitting part 30 is configured such that, when the face, which is the hitting surface of the hitting part 30, faces the hitting destination, the broader surface of the first flexible part 12 faces the hitting destination.

The rod-like object 1 for ball games having the above-described configuration can be used as follows. First, as shown in FIG. 3(*a*), a user stands in front of a ball B to be at address toward the hitting destination that is on the right in the drawing. In this state, the first flexible part 12 is positioned so as to deflectively deform along the first imaginary plane extending rightward and leftward from the user, and the second flexible part 14 is positioned so as to deflectively deform along the second imaginary plane extending forward and backward from the user.

Then, the user performs a backswing. When initiating a backswing, the user swings up the rod-like object 1 in the lateral direction (to the left in FIG. 3(*a*)) mainly by the rotation of the body to cause the first flexible part 12 to flex in the direction of the swing. Thereafter, the rod-like object 1 is further swung up in the vertical direction mainly by the movement of the arms to cause the second flexible part 14 to flex in the direction of the swing. After the backswing is completed in this way, the user successively performs a downswing.

When initiating a downswing, the waist is counter-rotated to start pulling the grip 20 downward. At this time, as shown in FIG. 3(*b*), the flex direction of the second flexible part 14 (to the right in FIG. 3(*b*)) during the backswing is maintained. Then, due to a counter movement in the vertical direction performed by the user, the hitting part 30 is greatly accelerated downward, and the flex direction of the second flexible part 14 is inverted. Thereby, a large downward inertial force together with gravity acts on the hitting part 30. The aforementioned counter movement means a movement that causes a force to act on the grip 20 in the direction opposite to the direction of the swing to decelerate the motion of the grip 20 (the same also applies below).

Thereafter, when the user swings the rod-like object 1 in the lateral direction toward the ball B by the rotation of the body, the first flexible part 12 greatly deflects in the direction opposite to the direction of the swing due to the downward inertial force remaining in the hitting part 30. Then, due to a counter movement in the lateral direction performed by the user, the hitting part 30 is greatly accelerated in the hitting direction and, as shown in FIG. 3(*c*), the flex direction of the second flexible part 14 is inverted toward the right in the drawing. Thus, while causing the second flexible part 14 to flex in the hitting direction, the ball B is hit.

In this way, according to the method for using the rod-like object 1 of this embodiment, the counter movement in the vertical direction and the counter movement in the lateral direction sequentially performed during the downswing make it possible to reliably store large elastic energy resulting from the deflective deformations of the first flexible part 12 and the second flexible part 14 in the rod-like object 1. Then, it is possible to stably release this elastic energy when hitting the ball B and thus to accurately drive the ball B far.

In the rod-like object 1 for ball games of this embodiment, the principal deflective deformations of the first flexible part 12 and the second flexible part 14 are limited to being in the directions of the first imaginary plane and the second imaginary plane, respectively, and therefore, for example, in the case of using this rod-like object 1 for golf swing practice, a user can easily check whether an efficient swing is accomplished or not by feeling the deflections of the first flexible part 12 and the second flexible part 14 during a swing. Also, forming the first flexible part 12 and the second flexible part 14 in a flat shape makes it possible for a user to visualize in what directions the first flexible part 12 and the second flexible part 14 should be flexed even before making a swing, and can encourage an efficient swing. One or more slits extending in the longitudinal direction may be formed in the first flexible part 12 and the second flexible part 14, and this enables flex to occur more easily.

In the case of using the rod-like object 1 as a golf club, it encourages a user to make an efficient swing and makes it possible to promote an improvement of the distance of ball flight and directional accuracy. The ease of deflection of the first flexible part 12 and the second flexible part 14 may be suitably set according to, e.g., the physical strength of a user and the purpose of use, and, for example, in the case of using the rod-like object 1 for practice, it is preferable that the rod-like object is configured with the first flexible part 12 and the second flexible part 14 that are easily deflectively deformable to allow the user to easily feel an efficient swing.

One embodiment of the present invention has been described in detail above, but the specific aspects of the present invention are not limited to the above embodiment. For example, although in this embodiment the rod-like object is configured to make it easy to feel flex by positioning the second flexible part 14 that deflectively deforms due to the movement in the vertical direction on the proximal end side relative to the first flexible part 12 that deflectively deforms due to the movement in the lateral direction for allowing the hitting part 30 to be more greatly displaced by the movement in the vertical direction than by the movement in the lateral direction, conversely, it is also possible for a user to more easily feel the movement in the lateral direction by changing the orientation of the broader surfaces of the first flexible part 12 and the second flexible part 14 such that the first flexible part 12 deflectively deforms due to the movement in the vertical direction and the second flexible part 14 deflectively deforms due to the movement in the lateral direction. The first flexible part 12 and the second flexible part 14 may be formed by twisting the middle of a strip-like object to provide them on the respective sides of the twisted portion.

Figure 5A:
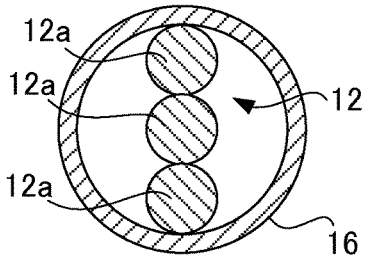
FIGS. 5(*a*)-5(*b*) include cross-sectional views showing relevant parts of a rod-like object for ball games according to yet another embodiment of the present invention, and FIG. 5(*a*) is a cross-sectional view of a first flexible part and FIG. 5(*b*) is a cross-sectional view of a second flexible part.
Figure 5B:
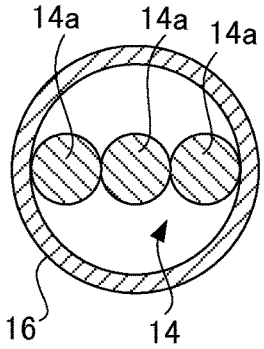

Moreover, as shown in the cross-sectional views in FIGS. 4(*a*) and 4(*b*), it is also possible to accommodate the first flexible part 12 and the second flexible part 14 in a cylindrical covering tube 16 that integrally covers both parts. For the covering tube 16, the same shaft as that used for an ordinary golf club, such as a steel shaft or a carbon shaft, can be used, and thus the rod-like object of the present invention can be configured to appear in the same way as a commonly used golf club. The first flexible part 12 and the second flexible part 14 have a flat, rectangular cross-sectional shape in FIGS. 4(*a*) and 4(*b*), but as shown in the cross-sectional views in FIGS. 5(*a*) and 5(*b*), each may be configured into a flat, plate-like object by parallelly arranging a plurality of linear objects 12*a* or 14*a* in one direction so as to be in contact with each other and integrating them into a single body.

Figure 6A:
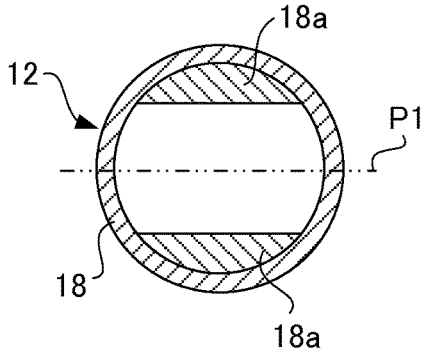
FIGS. 6(*a*)-6(*b*) include cross-sectional views showing relevant parts of a rod-like object for ball games according to yet another embodiment of the present invention, and FIG. 6(*a*) is a cross-sectional view of a first flexible part and FIG. 6(*b*) is a cross-sectional view of a second flexible part.
Figure 6B:
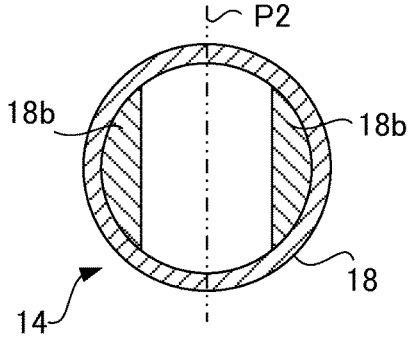

Moreover, as shown in the cross-sectional views in FIGS. 6(*a*) and 6(*b*), it is possible to configure the first flexible part 12 that deflectively deforms along the first imaginary plane P1 and the second flexible part 14 that deflectively deforms along the second imaginary plane P2 by placing solid parts 18*a* and 18*a* and solid parts 18*b* and 18*b*, which are to be formed on the inner circumferential surface of a cylindrical shaft 18, in different height positions in the longitudinal direction and in different positions in the circumferential direction of the shaft 18. In this embodiment, the first flexible part 12 has a pair of solid parts 18*a* and 18*a* that are provided so as to face each other, but the first flexible part 12 may be configured to have either one of the solid parts. The same applies to the solid parts 18*b* and 18*b* of the second flexible part 14 as well. Instead of forming the solid parts on the inner circumferential surface of a cylindrical shaft as in this embodiment, it is also possible to partially form the solid parts along the outer circumferential surface of the shaft, and it is also possible to form the solid parts by multiple layers. Also, the solid parts can be formed by, for example, altering the thickness of a coating film applied to the shaft 18 in the circumferential direction, or in the case of a carbon shaft, by partially increasing the amount of carbon sheet used. When the second flexible part 14 has a graspable shape, the proximal end part of the second flexible part 14 may be configured to serve as the grip 20 as well.

The shape that determines the principal direction of deflective deformation of the main body 10 may be any shape, and a shape by which the direction of deformation is visually apparent is preferable. As for such a configuration other than the flat, strip-like object as in this embodiment, an example may be a configuration that has an elliptical cross-sectional shape. For example, as shown in the cross-sectional views in FIGS. 7(*a*) and 7(*b*), forming the first flexible part 12 and the second flexible part 14 so as to have elliptical cross-sectional shapes and placing them such that their major axes L1 and L2 are perpendicular to each other enable the first flexible part 12 and the second flexible part 14 to deflectively deform along the first imaginary plane P1 and the second imaginary plane P2 to which the major axes L1 and L2, respectively, are perpendicular. In various embodiments, it is preferable that the first imaginary plane P1 and the second imaginary plane P2 are perpendicular on the axial line L of the main part 10, but as long as an efficient swing is encouraged, intersecting arrangements other than the perpendicular arrangement may be adopted. With a configuration in which the first imaginary plane P1 and the second imaginary plane P2 intersect each other, swinging the rod-like object 1 along the respective planes makes it possible, by taking advantage of the inertial force obtained due to the deflection of one of the first flexible part 12 and the second flexible part 14, to reliably store large elastic energy resulting from the flex of the other in the rod-like object 1 and to hit the ball hard and accurately. It is also possible to configure the angle formed between the first imaginary plane P1 and the second imaginary plane P2 to be multi-level adjustable by an angle adjustment mechanism such as a ratchet mechanism in which a pawl and a ratchet wheel engage.

Moreover, the first flexible part 12 and the second flexible part 14 can be formed as follows. That is, as shown in the development view in FIG. 8(*a*), lug parts 102 and 104 are formed on the respective right and left sides of a rectangular flat plate 100 such that these lug parts 102 and 104 are not immediately above or below relative to each other, and rolling this flat plate 100 into a cylindrical form to create the main part 10 places tip edges 102*a* and 104*a* of the lug parts 102 and 104 in different positions in the circumferential direction of the main part 10 as shown in FIG. 8(*b*). Then, when these tip edges 102*a* and 104*a* are welded to configure the main part 10 into a tubular form, welded parts W1 and W2 become so-called spines, i.e., portions with high flexural rigidity, and it is thus possible to form the first flexible part 12 and the second flexible part 14 that deflectively deform in mutually different directions in the upper and lower parts of the main part 10, respectively. Formation of the spines is not necessarily limited to welding, and, for example, thick portions resulting from overlapping of a carbon sheet when a carbon shaft is formed can be regarded as spines. In this configuration, as shown in FIG. 8(*c*), externally attaching a ring-shaped member 19*a* composed of, for example, an elastic material to the main part 10 to place the highly rigid part 19 between the first flexible part 12 and the second flexible part 14 makes it possible to prevent the flex of the first flexible part 12 and the flex of the second flexible part 14 from interfering with each other.

Figure 9:
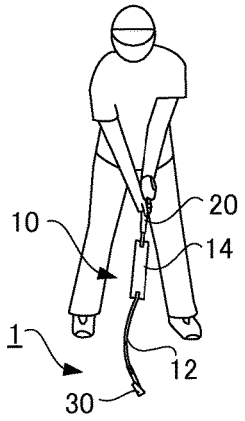
FIG. 9 shows a state at address of a rod-like object for ball games according to yet another embodiment of the present invention.

In all embodiments described above, the main part 10 is configured to have an linearly extending axial line but, for example, as shown in FIG. 9, the first flexible part 12 may have a shape that is curved in advance in the direction of a swing such that the first flexible part 12 at address has the same curved shape as the shape at impact. Using the rod-like object 1 having such a configuration mainly for practice makes it easy for a user at address to imagine the flex of the rod-like object 1 at impact, and the efficiency of the practice can be enhanced. The second flexible part 14 as well can have a shape that is curved in advance in the forward or backward direction of the user at address so as to make it easy for the user to imagine the toe-down phenomenon at impact. The curved shapes of the first flexible part 12 and the second flexible part 14 are not limited to those in this embodiment, and can be suitably selected according to the intended use.

The first flexible part 12 and the second flexible part 14 can be configured such that their flexural rigidities are adjustable according to the difference of a user in the amount of deflection that makes it easy for the user to feel the deflection, the level of proficiency, and the like. As for the configuration that enables adjustment of flexural rigidity, an example may be a method in which, for example, when the first flexible part 12 and the second flexible part 14 are in the form of strips, a plurality of additional strip-like objects are provided, and a suitable number of strip-like objects are stacked on the first flexible part 12 and the second flexible part 14 and fixed thereto by connecting means. Also, when the first flexible part 12 and the second flexible part 14 are in the form of hollow tubes, configuring the first flexible part 12 and the second flexible part 14 such that a wire inserted into a hollow part thereof can be wound up by a peg or the like for causing compressive force to be generated between opposite ends of the first flexible part 12 and the second flexible part 14 makes it possible to alter flexural rigidity.

Figure 10:
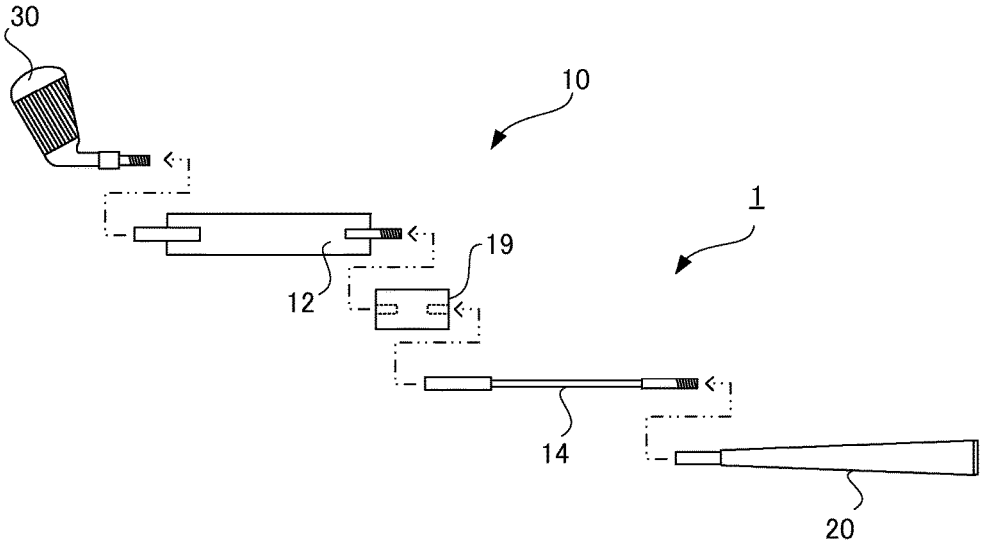
FIG. 10 is an exploded front view of a rod-like object for ball games according to yet another embodiment of the present invention.

As shown in FIG. 10, the first flexible part 12, the highly rigid part 19, and the second flexible part 14 can be configured so as to be attachable to and removable from the grip 20 and the hitting part 30 by, for example, screwing and unscrewing. This configuration makes it easy to switch the positions of the first flexible part 12 and the second flexible part 14 and, by providing a plurality of hitting parts 30 that have different shapes, also makes it easy to adjust the sole angle and the lie angle.

Different colors or patterns or the like may be given to the front and back surfaces of the first flexible part 12 and the second flexible part 14. This makes it possible to easily understand the extent of flex of the first flexible part 12 and the second flexible part 14 through, for example, photographing or filming the swing of a user, and the swing can be checked accurately.

Figure 11A:
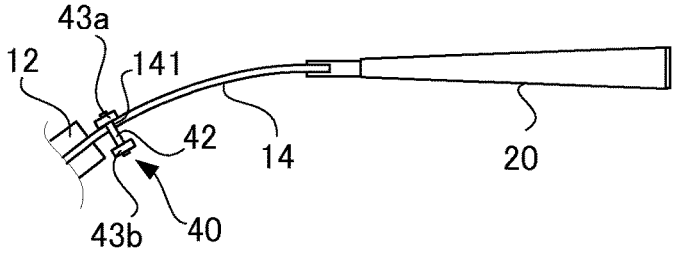
FIGS. 11(*a*)-11(*b*) include front views of relevant parts of a rod-like object for ball games according to yet another embodiment of the present invention, and FIG. 11(*a*) and FIG. 11(*b*) each show an example of the state during use.
Figure 11B:
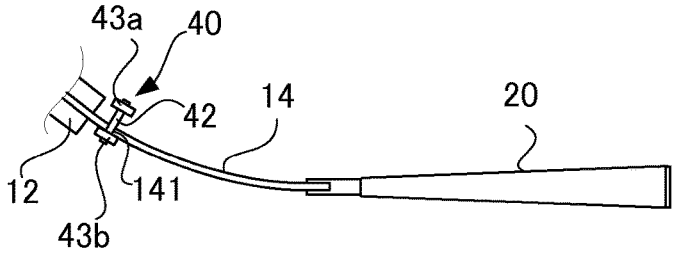

Moreover, as shown in FIGS. 11(*a*) and 11(*b*), a movable object 40 that moves due to flex may be provided at a tip part of the second flexible part 14. The movable object 40 is configured to include stoppers 43*a* and 43*b* at the respective ends of a rod 42 that is inserted into a through-hole 141 formed in the second flexible part 14, and is positioned such that a gap is created between the second flexible part 14 and either the stopper 43*a* or 43*b*. When the state shown in FIG. 4(*b*) in which the second flexible part 14 flexes upward is reached from the state shown in FIG. 4(*a*) in which the second flexible part 14 flexes downward during a swing of the rod-like object 1, the movable object 40 moves upward, and the stopper 43*b* collides with the second flexible part 14. A user can understand the flex state of the second flexible part 14 through vibrations and sounds generated at this time, and can check whether an efficient swing is being performed or not during a swing. As with the second flexible part 14, the first flexible part 12 can also have a configuration that causes vibrations, sounds, or the like to be generated due to flex.

As shown in FIG. 2(*a*), the highly rigid part 19 in this embodiment is formed in a cross shape but, as described above, as long as it is configured to have a flexural rigidity in the direction of the first imaginary plane P1 that is equal to or greater than the flexural rigidity of the second flexible part 14 in the same direction and a flexural rigidity in the direction of the second imaginary plane P2 that is equal to or greater than the flexural rigidity of the first flexible part 12 in the same direction, the material, the cross-sectional shape, and the like are not particularly limited. For example, when a cylindrical member is used as a member for connecting the first flexible part 12 and the second flexible part 14, a configuration in which the outer diameter of the cylindrical member is increased, a configuration in which a metal tape or the like is wound around the outer surface of the cylindrical member, a configuration in which a ring-like object is externally attached to the cylindrical member, a configuration in which a hollow part of the cylindrical member is filled with a packing, or a similar configuration can be adopted. The highly rigid part 19 can also be configured so as to be attachable to and removable from the first flexible part 12 and the second flexible part 14, and it is also possible to adopt a configuration in which the first flexible part 12 and the second flexible part 14 can be directly connected without the highly rigid part 19. Even with the rod-like object 1 that does not have the highly rigid part 19, an advanced user can perform the same swing as in the above-described method of use, and can generate the desired flex in both the first flexible part 12 and the second flexible part 14.

Figure 12:
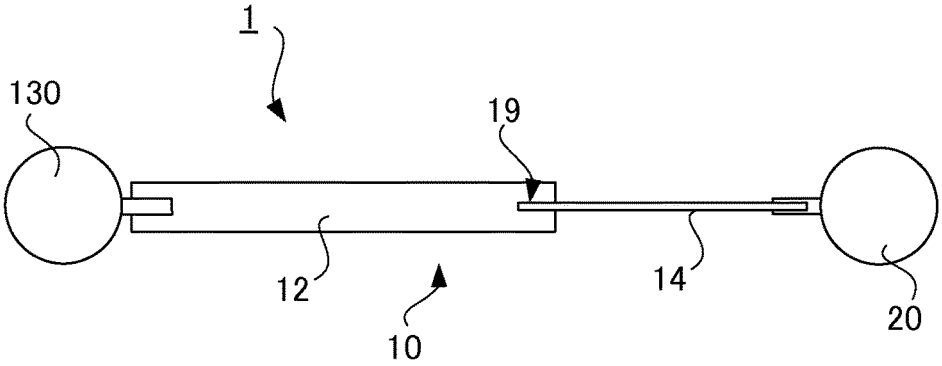
FIG. 12 is a front view of a rod-like object for ball games according to yet another embodiment of the present invention.

Other than golf, the present invention is applicable to various ball games in a broad sense in which an object to be hit, which is in the form of a ball, is hit with a rod-like object, and is also applicable to, for example, tennis or badminton rackets, ice hockey sticks, baseball bats, and the like. Furthermore, the rod-like object for ball games of the present invention can also be used for practicing throwing a ball such as a baseball other than for hitting an object to be hit. That is, as shown in FIG. 12, the rod-like object 1 can be configured by using a spherical object that has substantially the same size as a baseball ball or the like for the grip 20 and providing a weight 130 having, for example, a spherical shape in place of the hitting part 30 in the rod-like object 1 shown FIG. 1. According to the rod-like object 1 shown in FIG. 12, when a user performs a ball-throwing movement, assuming the grip 20 as a ball, it is possible to easily feel an efficient ball-throwing form in which inertial force due to the flex of one of the first flexible part 12 and the second flexible part 14 is used to cause the other to flex greatly.

REFERENCE SIGNS LIST

1. Rod-like object for ball games
10. Main part

12. First flexible part
14. Second flexible part
19. Highly rigid part
20. Grip
30. Hitting part
L. Axial line
P1. First imaginary plane
P2. Second imaginary plane

The invention claimed is:

1. A rod-like object for ball games usable for ball games or practice thereof, the rod-like object comprising a grip on a proximal end side of an elongated main body, the main body extending in an axis, and the main body, comprising a first flexible part in which primary deflective deformation occurs in a first imaginary direction (Y), the primary deflective deformation being defined as a largest deformation of the first flexible part observed when multiple forces are applied to the first flexible part around the axis and the first imaginary direction being defined as a direction in which a flexural rigidity of the first flexible part is minimal, a second flexible part that is provided more toward the proximal end side than the first flexible part is and in which principal deflective deformation occurs in a second imaginary direction (X), the principal deflective deformation being defined as a largest deformation of the second flexible part observed when multiple forces are applied to the second flexible part around the axis and the second imaginary direction being defined as a direction in which a flexural rigidity of the second flexible part is minimal, a grip part that is positioned inside the grip where a user is expected to grip, which is farther toward the proximal end side than the second flexible part, the grip part having a uniform flexural rigidity around the axis, and a highly rigid section interposed between the first flexible part and the second flexible part, wherein the highly rigid section has a flexural rigidity in the first imaginary direction (Y) that is greater than a flexural rigidity of the second flexible part in the same direction as the first imaginary direction, and that is greater than the uniform flexural rigidity of the grip part, and another flexural rigidity in the second imaginary direction (X) that is greater than a flexural rigidity of the first flexible part in the same direction as the second imaginary direction, and that is greater than the uniform flexural rigidity of the grip part.

2. The rod-like object for ball games according to claim 1, wherein the first flexible part and the second flexible part both have a length longer than a length of the highly rigid section.

3. The rod-like object for ball games according to claim 1, wherein the first flexible part and the second flexible part are both formed in a flat shape and are flexible in a thickness direction.

4. The rod-like object for ball games according to claim 2, wherein the first flexible part and the second flexible part are both composed of a flat, plate-like object and are flexible in a thickness direction of the plate-like object, and the highly rigid section is formed by the first and second flexible parts intersecting at a substantially right angle such that a cross sectional shape of the highly rigid section seen in a direction of the axis is a cross.

5. The rod-like object for ball games according to claim 4, wherein the first flexible part, the highly rigid section, and the second flexible part all have a center line positioned on a straight line along an axial line of the main body.

6. The rod-like object for ball games according to claim 5, wherein a first imaginary plane along which the primary deflective deformation occurs and a second imaginary plane along which the principal deflective deformation occurs are both positioned so as to include the axial line of the main body and are perpendicular to each other.

7. The rod-like object for ball games according to claim 5, wherein the highly rigid section has such a shape that the first flexible part and the second flexible part intersect on the axial line of the main body.

8. The rod-like object for ball games according to claim 4, wherein the main body comprises a ball hitting part at its tip, and the ball hitting part faces in the first imaginary direction (Y).

9. The rod-like object for ball games according to claim 4, wherein the plate-like objection of the first flexible part has a width, which is determined in a width direction perpendicular in the first imaginary direction, and the width of the first flexible part is twice or more as large as that of the grip part in the width direction.

10. The rod-like object for ball games according to claim 9, wherein the plate-like objection of the second flexible part has a width, which is determined in a width direction perpendicular in the second imaginary direction, and the width of the second flexible part is twice or more as large as that of the grip part in the width direction.

11. The rod-like object for ball games according to claim 1, wherein the first flexible part is composed with a plurality of linear objects that extend along the axis and aligned in a direction perpendicular to the first imaginary direction such that two of the linear objects, which are adjacent in the perpendicular direction, are in contact, and a number of the linear objections is at least three.

12. The rod-like object for ball games according to claim 11, wherein the second flexible part is composed with a plurality of linear objects that extend along the axis and aligned in a direction perpendicular to the second imaginary direction.

13. The rod-like object for ball games according to claim 12, further comprising:

a shaft that extends along the axis and has a hollow inside, wherein the plurality of linear objects in the first and second flexible parts are placed inside the shaft.

* * * * *